US005326167A

United States Patent [19]

Ware et al.

[11] Patent Number: 5,326,167

[45] Date of Patent: Jul. 5, 1994

[54] LABORATORY FLASK STIRRER ASSEMBLY ATTACHABLE WITH A NUT AND BOLT

[75] Inventors: Steven Ware, Vineland; Howard Hayman, Elmer, both of N.J.

[73] Assignee: Chemglass, Inc., Vineland, N.J.

[21] Appl. No.: 23,837

[22] Filed: Feb. 23, 1993

[51] Int. Cl.[5] ..... B01F 7/20

[52] U.S. Cl. ..... 366/247; 366/308; 366/331; 416/131; 416/142; 416/205

[58] Field of Search ..... 366/129, 244–247, 366/249, 273, 274, 308, 326, 331, 342, 343, 605; 416/3, 72, 142, 131, 205

[56] References Cited

U.S. PATENT DOCUMENTS

| | | | |
|---|---|---|---|
| 1,447,653 | 3/1923 | Fish | 366/308 X |
| 1,711,114 | 4/1929 | Hunt | 416/142 |
| 1,734,120 | 11/1929 | Farrington | 416/142 X |
| 1,827,004 | 10/1931 | Gibson | 366/308 |
| 1,841,435 | 1/1932 | Gibson | 366/308 |
| 2,130,542 | 9/1938 | Giddings | 366/308 |
| 2,711,306 | 6/1955 | Levi | 366/273 |
| 2,816,743 | 12/1957 | Kirkland | 366/247 |
| 2,829,931 | 4/1958 | De Pree et al. | 366/331 X |
| 2,859,020 | 11/1958 | Eddy et al. | 366/308 X |
| 3,169,014 | 2/1965 | Wilson et al. | 366/308 X |
| 3,207,489 | 9/1965 | Berman | 366/308 |
| 3,223,389 | 12/1965 | Simmonds | 416/142 |
| 3,251,635 | 5/1966 | Phillips | 366/308 X |
| 3,455,540 | 7/1969 | Marcmann | 416/142 |
| 4,355,906 | 10/1982 | Ono . | |
| 4,872,764 | 10/1989 | McClean . | |
| 4,981,367 | 1/1991 | Brazelton . | |
| 5,183,336 | 2/1993 | Poltorak et al. | 366/308 X |

FOREIGN PATENT DOCUMENTS

| | | | |
|---|---|---|---|
| 266732 | 5/1988 | European Pat. Off. | 366/343 |
| 1016037 | 9/1957 | Fed. Rep. of Germany | 366/308 |
| 1326209 | 3/1963 | France | 366/308 |
| 618123 | 1/1986 | Japan | 366/343 |

OTHER PUBLICATIONS

Ace Glass Catalog, "Trubore Stirrers", pp. 266–269, date unknown.

Kontes Catalog, "Stirrers", pp. 290 and 291, date unknown.

Lab Glass Catalog, "Stirrers", pp. 238–241, date unknown.

*Primary Examiner*—Stephen F. Gerrity
*Assistant Examiner*—Charles Cooley
*Attorney, Agent, or Firm*—Lowe, Price, LeBlanc & Becker

[57] ABSTRACT

A stirring system for stirring contents in a laboratory flask having a round or spherical bottom and a reduced neck includes a stirrer shaft manufactured with a ring at the lower end thereof which permits attachment of a blade with a nut and bolt made of TEFLON material. The nut and bolt prevents the stirrer blade from flipping over during assembly and allows for a controlled tightening force to be applied to ensure that the blade remains in proper stirring position during use. The nut and bolt design permits use of the shaft with any stirrer blade having a keyhole cutout or circular opening. A method of stirring contents in a laboratory flask by attachment of the stirrer blade to the stirrer shaft with a nut and bolt is also disclosed.

14 Claims, 2 Drawing Sheets

FIG. 1
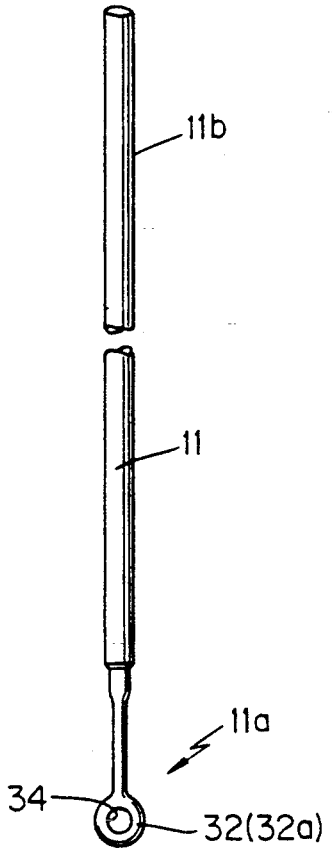
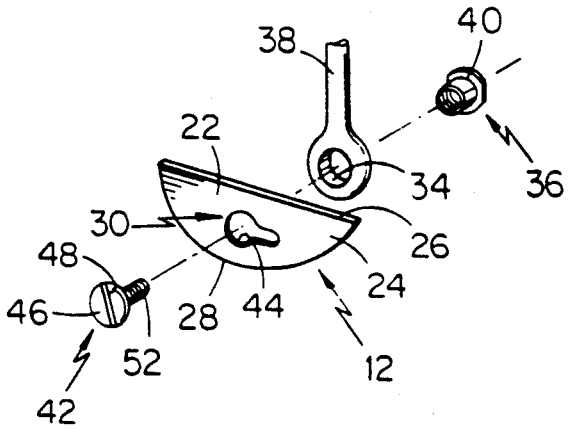
FIG. 1A
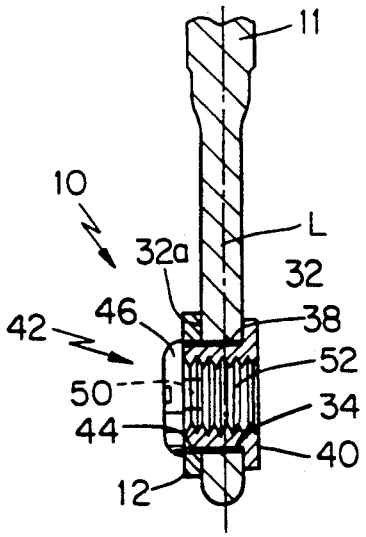
FIG. 3

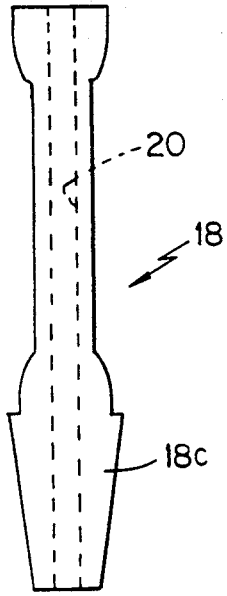
FIG. 2A
FIG. 2
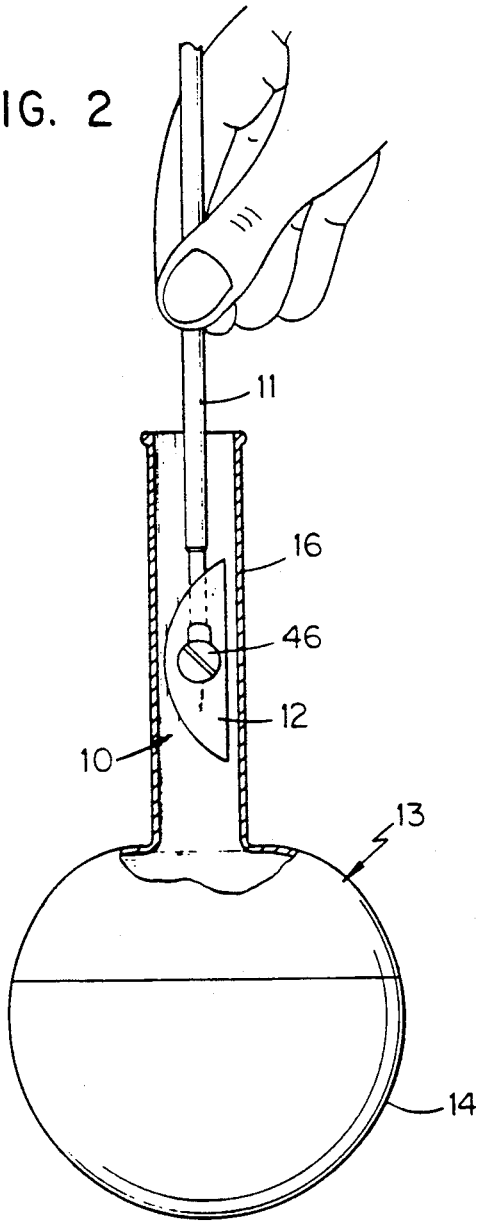
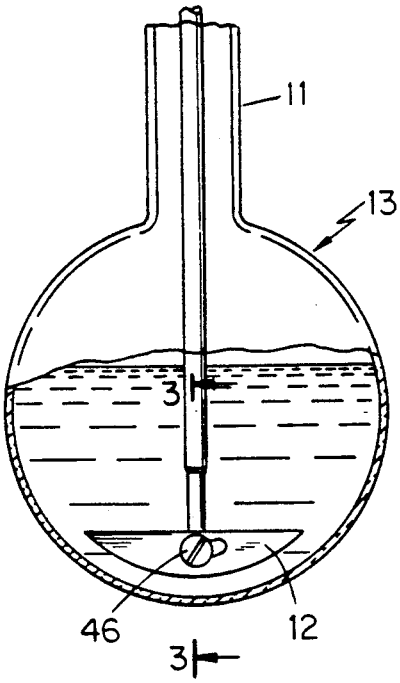
FIG. 4
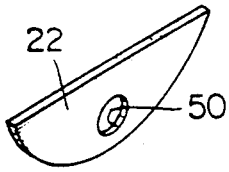
FIG. 5

LABORATORY FLASK STIRRER ASSEMBLY ATTACHABLE WITH A NUT AND BOLT

TECHNICAL FIELD

The present invention relates generally to a stirrer blade and shaft assembly and, more particularly, to a stirrer blade for use in connection with round bottom flasks such as those employed in chemical laboratories, with the blade adapted to be mounted onto a stirrer shaft and supported at the bottom of the shaft.

BACKGROUND ART

Stirrer blades are commonly used in conjunction with laboratory flasks wherein the blades have a straight or flat top edge and a rounded bottom edge that generally conforms to the inside bottom curvature of the flask. The blade is curved to more closely associate itself with the flask for stirring a material therein. Therefore, in a proper position of conventional stirring blades, the curved bottom edge is facing downwardly and generally fits the curvature of the flask with the flat edge up.

Considerable difficulties arise when installing the conventional stirring blade since the blade often becomes inverted. Should this occur, the flat edge is disposed downwardly and is therefore not oriented to properly stir material within the flask. It is necessary to disassemble the apparatus to correct this condition. This condition generally occurs as a result of the method of installing the stirrer assembly which is accomplished by turning the blade so that its long axis parallels that of the rod or shaft. Then, after installing the blade and the shaft through a narrow neck of the flask, or through a glass bearing inserted into the top opening of the neck, the blade must then be rotated through 90° to the proper position. Many times the blade turns in the wrong direction thereby causing the aforesaid inversion to occur.

To enable the blade to be inserted through the narrow neck of the flask, as mentioned above, the blade must first be oriented so that its long axis is perpendicular to the neck mouth and therefore parallel to that of the rod or shaft to which it is attached. After installing the blade and shaft through the narrow neck, or after installing the upper end of the shaft through the lower end of the glass bearing following which the blade is then inserted through the narrow neck of the flask followed by the bearing, the blade must then rotate through 90° to the proper position. To enable this to occur, as disclosed in U.S. Pat. No. 3,207,489, it is common practice in the industry to form the shaft or glass rod to have a laterally extending lower end portion terminating in a circular vertical flange having a diameter greater than the largest diametral opening formed in the blade. This opening is the larger part of a keyhole shaped opening in the blade which enables the blade to be assembled in relation to the shaft or rod by first inserting the upper end of the shaft through the larger diametral opening and then sliding the blade downwardly along the entire length of the shaft towards the laterally extending lower end portion or foot defining the bottom end of the shaft. There is also a projecting member on the bottom end of the shaft or foot which the slotted portion of the keyhole opening must be aligned with to enable the blade to pass over the projecting member and onto the foot into engagement with the flange. When the blade is then rotated so the keyhole shaped opening is no longer in alignment with the lower projecting member, the blade is retained on the foot by being sandwiched between the lower projecting member and the circular flange.

Therefore, one of the disadvantages of the stirrer assembly of the aforementioned U.S. Pat. No. 3,207,489 is that the blade (1) must first be mounted to the shaft by (2) passing the upper shaft end through the keyhole shaped opening and then (3) sliding the blade along the entire length of the shaft and around the lower projection so that the aforementioned (4) interlocking of the blade to the shaft can occur. This is time-consuming and sometimes cumbersome within a laboratory environment. Once the blade is mounted to the shaft in the aforementioned manner, care must then be taken to rotate the blade so that the long axis is parallel to shaft with the keyhole part of the opening facing upwardly and away from the lower projecting portion and not downwardly in alignment with that projection. Otherwise, the stirrer blade could flip off the shaft during assembly.

It is accordingly an object of the present invention to provide a stirrer assembly wherein the stirrer blade is securely mounted to the stir shaft to avoid flip-over during assembly and insertion into a flask.

Another object is to provide a stirrer blade assembly wherein the amount of tension for securing the blade to the stir shaft can be controlled.

Yet a further object is to provide a stirring blade attachment system having a new and improved stir shaft which is manufactured to permit attachment of the blade with a "TEFLON " material nut and bolt.

Still another object is to provide a stirring blade attachment system with a new and improved stir shaft which is formed without the bottom projection and which therefore presents fewer projections which are likely to come in contact with the flask and result in breakage of the projections in the flask or breakage of the flask bottoms particularly in the event that the blade has flipped off the stir shaft as occurred in the prior art.

SUMMARY OF THE INVENTION

A stirrer assembly for stirring contents in a laboratory flask having a round or spherical bottom and a reduced neck, in accordance with the present invention, comprises a stirrer shaft and a stirrer blade attached to the lower end thereof with a nut and bolt assembly.

The stirrer shaft preferably has a ring shaped lower end including a throughbore extending generally at right angles to the axis of the shaft. The nut and bolt assembly preferably includes a nut having a nut portion adapted to extend through the throughbore and a larger diameter flange adapted to bear against one side of the ring. The bolt has a through head and a threaded projection adapted to extend through the blade for threaded attachment with the nut portion while the screw head bears against the blade to impart a controlled amount of tightening resistance between the blade and ring. Advantageously, the controlled tightening force eliminates the frustration of having the stirrer blade flip over during assembly due to the proper amount of tension that can be applied with the nut and bolt assembly.

The nut and bolt assembly enables the blade to be pivotably mounted to the shaft for rotation about the screw axis between an installation position whereby the long axis of the blade is parallel to the shaft axis, and a stirring position whereby the long axis of the blade is perpendicular to the shaft axis.

The blade preferably includes a keyhole shaped opening including a circular cutout through which the bolt extends and a slotted cutout intersecting the circular cutout. The screw head has a larger diameter than the circular cutout and further includes a smaller diameter hub projecting from one side of the head to fit within the circular cutout. The hub is dimensioned larger than the width of the slotted cutout so as to be retained within the circular opening to prevent the blade from floating on the screw. The threaded projection extends from the hub into the nut portion.

The nut and bolt are preferably made of a plastics material, such as "TEFLON" material.

The blade may be formed only with a circular opening in which case the nut and bolt assembly may or may not include the hub portion. It is to be understood that a blade formed with a keyhole shaped cutout is commercially available and conventional within the industry.

The stirrer system of this invention may be used with a bearing having a lower end portion adapted to seat within the neck of the flask, and an upper reduced portion, the upper and lower portions having a throughbore through which the shaft extends.

A method of stirring contents of a laboratory flask is also disclosed. The method comprises the steps of mounting a stir blade to the lower end of a stirrer shaft with a nut and bolt assembly. The blade is then tightened to the shaft and the blade is inserted into the flask through the reduced neck by orienting the long axis of the blade with the axis of the stirrer shaft. After the blade enters the flask, it is pressed against the interior bottom surface of the flask to rotate the blade 90° so that its long axis is perpendicular to the shaft axis and therefore in a stirring position. Back and forth rotation of the shaft about its axis causes corresponding stirring movement of the blade.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BRIEF DESCRIPTION OF THE DRAWING

FIG. 1 is a perspective view of a stirring shaft in accordance with the present invention;

FIG. 1A is an exploded perspective view of a stirrer assembly in accordance with the present invention;

FIG. 2 is a detailed sectional view of the stirrer blade and shaft of this invention inserted through the narrow neck of a round bottom laboratory flask;

FIG. 2A is a sectional view of an optical bearing;

FIG. 3 is a detailed sectional view taken along the line 3—3 of FIG. 4;

FIG. 4 is a view similar to FIG. 2 but with the stirrer blade positioned adjacent to the bottom surface of the flask; and;

FIG. 5 is a plan view or alternate embodiment of a blade for use with this invention.

BEST MODE FOR CARRYING OUT THE INVENTION

Referring to FIGS. 1, 1A and 3, stirrer blade assembly 10 of the present invention comprises a stirring shaft 11 having a stirrer blade 12 attached to the lower end 11*a* thereof, which is adapted preferably for use in combination with a laboratory flask 13 having a round or spherical bottom 14 and an elongate, reduced neck 16 which may receive the lower end 18*c* of a precision bore bearing 18 (FIG. 2A only). The bearing 18 is formed with a precision ground throughbore 20 through which shaft 11 extends in supported bearing alignment with the flask interior. The upper end 11*b* of shaft 11 projects upwardly from bearing 18 and is gripped either manually or by machine (as is well known) and twirled rapidly in opposite directions to generate corresponding movement of blade 12 (in the FIG. 4 position) to thereby stir the contents within the flask 13. The unique manner in which blade 12 is secured to shaft 11 constitutes the novel feature of this invention and the particular construction of the flask 13 and bearing 18 forms no critical part of the present invention but is related to the stirrer blade assembly 10 in a novel manner discussed below.

The stirrer blade 12 may be conventional and generally comprises a flat member 22 having parallel faces 24 and a straight upper edge 26 and a convex lower edge 28 intersecting the upper edge at opposite ends thereof. The curvature of the lower edge 28 generally conforms with the curvature of the rounded bottom 14 of flask 13.

The blade 12 has a keyhole shaped opening 30 therein which enables the blade to be rotatably mounted to the lower end 11*a* of shaft 11. More specifically, the lower end 11*a* is formed with a ring 32 having a preferably smooth cylindrical throughbore 34 extending therethrough at right angles to the shaft axis L as best depicted in FIG. 3. This, throughbore 34 receives a nut 36 (preferably TEFLON material or plastic material) inserted into the throughbore through one end thereof so that a nut portion 38 is coaxially mounted within the throughbore and retained therein by means of an annular flange 40 formed at one end of the nut to bear against one face 32*a* of the ring 32. A TEFLON material screw 42 (preferably TEFLON material or plastic material) passing through the circular opening part 44 of the keyhole shaped opening 30 is threadedly received in the nut portion 38 to rotatably secure the blade 12 to the shaft lower end 11*a* as depicted in FIG. 2. More specifically, the screw head 46 has a slot 48 formed in an outer face thereof and which is adapted to receive the blade of a screwdriver (not shown). A reduced diameter cylindrical hub 50 extends from the inner face of the screw head 46 for insertion into the circular opening 44 of the keyhole shaped opening 30 in the blade 12. The threaded screw portion 52 projects from this hub 50 for entry into the nut portion 38 to thereby captivate the blade 12 between the screw head 46 and against the opposite face of the ring 32.

The height of the screw hub 50 is preferably slightly less than the thickness of the blade 12 so that tightening pressure is transmitted against the blade by the screw head 46 to create a desired amount of tension or tightening pressure between the blade and shaft lower end 11*a*.

The TEFLON material nut 36 and bolt 42 assembly according to this invention, in combination with the feature of a ring 32 formed in the lower end 11*a* of the shaft 11, advantageously results in a new and improved blade attachment system 10 having numerous advantages over the known prior art of which I am presently aware. For example, the nut and bolt arrangement 36,42 eliminates the frustration of having the stir blade flip over during assembly due to the proper amount of controlled tension that can now be applied to the blade 12 with the TEFLON material nut and bolt assembly. This proper amount of tension enables the long axis of the blade 12 to be initially aligned with the shaft axis L after the upper end 11*b* of the shaft 11 is initially inserted through the lower end 18*c* of the bearing 18 to enable the blade to be then inserted into the flask interior through the reduced neck 16 (FIG. 2), following which the lower end 18*c* of the bearing is seated into the reduced neck. The stir blade 12 is then depressed downwardly against the flask bottom interior to pivot the blade 90° into stirring position (FIG. 4) with its long or major axis now perpendicular to the stirring shaft 11. The generally constant tension or tightening pressure afforded by the nut and bolt assembly 36,42 advantageously enables the stir blade 12 to maintain this desired orientation relative to the shaft 11 to achieve optimum stirring results during use.

The unique blade attachment system 10 of this invention eliminates the need for a stirring shaft formed with a lower projecting portion as known in the prior art which was necessary to align with the slotted cutout of the keyhole shaped opening to enable mounting of the blade to the shaft in the manner described above. This lower projecting portion was brittle and easily susceptible to breakage during shipping, unpackaging, or actual use within the flask. In contrast, the ring shaped lower end 32 in the stir shaft 11 of the present invention has smooth surfaces which minimize the likelihood of breakage during shipment or use.

Furthermore, attachment of the blade 12 to the shaft lower end 11*a* with the nut and bolt assembly 36,42 of this invention is easy, in contrast to the aforementioned prior art wherein attachment could only occur by inserting the shaft upper end through the keyhole shaped opening to slide the blade along the entire length of the shaft and around the lower end into the mounted position.

As mentioned above, the stirring blade 12 is preferably constructed of "TEFLON" material, but may also be constructed of another plastic material as well as glass or metal. The dimensions of the blade 12 may vary depending upon the particular size of flask 13 with which the blade is to be used. The glass stirring shaft 11 is usually attached to an electrically powered stirring motor as is well known and the material from which the blades are preferably constructed is firm but not brittle, and resistant to breakage. The feature of a plastic or TEFLON material nut and bolt assembly prevents the shaft lower end 32 from coming into contact and scratching the bottom of the flask 13.

The keyhole shaped opening 30 is obviously not necessary for use in the present invention and may be substituted with a circular opening 50 instead. Advantageously, however, the nut and bolt assembly of the present invention enables use of conventional blades formed with keyhole shaped openings by providing an effective attachment mechanism and method, as aforesaid.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

We claim:

1. A stirrer system for stirring contents in a laboratory flask having a round or spherical bottom and a reduced neck, comprising:

(a) a stir shaft;

(b) a stir blade; and (c) a nut and bolt assembly for pivotally attaching the stir blade to the stir shaft, wherein said stir shaft has a donut ring-shaped lower end including a throughbore in said lower end extending generally at a right angle to a shaft axis of the stir shaft and said nut and bolt assembly is received in said throughbore.

2. A stirrer system for stirring contents in a laboratory flask having a round or spherical bottom and a reduced neck, comprising:

(a) a stir shaft;

(b) a stir blade; and (c) a nut and bolt assembly for pivotally attaching the stir blade to the stir shaft, wherein said stir shaft has a donut ring-shaped lower end including a throughbore therein extending generally at a right angle to a shaft axis of the stir shaft, wherein said nut and bolt assembly includes a nut having a nut portion extending through the throughbore and said nut further including a large diameter flange bearing against one side of the ring, and further including a bolt having a screw head and a threaded projection extending through the blade for threaded attachment with the nut portion with the screw head bearing against the blade to impart a controlled amount of tightening resistance between the blade and ring.

3. The stirrer system of claim 2, wherein said nut and bolt assembly enable the blade to be pivotally mounted to the shaft for rotation about a longitudinal axis of the bolt between an installation position whereby a long axis of the blade is parallel to the shaft axis and a stirring position whereby the long axis of the blade is approximately perpendicular to the shaft axis.

4. The stirrer system of claim 3, wherein said nut and bolt are each made of a plastic material.

5. The stirrer system of claim 3, wherein said blade is formed only with a circular opening.

6. The stirrer system of claim 3, further comprising a bearing having a lower end portion adapted to seat within the neck and an upper reduced portion, the upper and lower portions having a throughbore through which the shaft extends.

7. A stirrer system for stirring contents in a laboratory flask having a round or spherical bottom and a reduced neck, comprising:

(a) a stir shaft;

(b) a stir blade; and (c) a nut and bolt assembly for attaching the stir blade to the stir shaft, wherein said stir shaft has a ring-shaped lower end including a throughbore therein extending generally at a right angle to a shaft axis of the stir shaft, wherein said nut and bolt assembly includes a nut having a nut portion extending through the throughbore and said nut further including a large diameter flange bearing against one side of the ring, and further including a bolt having a screw head and a threaded projection extending through the blade for threaded attachment with the nut portion with the screw head bearing against the blade to impart a controlled amount of tightening resistance between the blade and ring, wherein said nut and bolt assembly enable the blade to be pivotally mounted to the shaft for rotation about a longitudinal axis of the bolt between an installation position whereby a long axis of the blade is parallel to the shaft axis and a stirring position whereby the long axis of the blade is approximately perpendicular to the shaft axis, wherein the blade includes a keyhole shape opening including a circular opening through which the bolt extends and a slotted opening intersecting the circular opening, said screw head having a larger diameter than the circular opening and further including a smaller diameter hub projecting from one side of the screw head to fit within the circular opening, said hub being dimensioned larger than the width of the slotted opening so as to be retained within the circular opening, said threaded projection extending from the hub.

8. The stirrer system claim 7, wherein said nut and bolt are each made of a plastic material.

9. A method of stirring contents of a laboratory flask having a rounded or spherical bottom and a reduced neck, with a stirring assembly including a stirrer shaft and a stirrer blade, comprising the steps of:

(a) mounting the blade to the shaft with a nut and bolt assembly by passing the bolt through an opening in the blade and through a throughbore formed in a ring shaped lower end of the shaft;

(b) tightening the blade to the shaft with the nut received on the bolt;

(c) inserting the blade into the flask through the reduced neck by orienting a long axis of the blade with an axis of the stirrer shaft;

(d) pressing the blade against the interior bottom surface of the flask to rotate the blade about 90° so that its long axis is now perpendicular to the shaft axis; and (e) rotating the shaft about its axis to stir the contents with said blade.

10. The method of claim 9, further comprising a bearing having a lower end portion adapted to seat within the neck and an upper reduced portion, the upper and lower portions having a throughbore through which the shaft extends, and comprising the further steps of initially inserting the upper end of the shaft into the lower end of the bearing so that it projects through the upper end of the bearing; seating the lower end of the bearing into the reduced neck of the flask; and then pressing said blade against the interior bottom surface of the flask.

11. A method of stirring contents of a laboratory flask having a rounded or spherical bottom and a reduced neck, with a stirring assembly including a stirrer shaft and a stirrer blade, comprising the steps of:

(a) mounting the blade to the lower end of the shaft with a nut and bolt assembly;

(b) tightening the blade to the shaft;

(c) inserting the blade into the flask through the reduced neck by orienting a long axis of the blade with an axis of the stirrer shaft;

(d) pressing the blade against the interior bottom surface of the flask to rotate the blade about 90° so that its long axis is now perpendicular to the shaft axis; and (e) rotating the shaft about its axis to stir the contents with said blade, wherein a conventional stirrer blade having a keyhole shaped opening is used as the stirrer blade, and wherein the mounting step includes the step of inserting a hub portion of the bolt into a circular opening portion of the keyhole shaped opening, which hub portion has a larger diameter than a width of a slotted portion of the keyhole shaped opening intersecting the circular opening portion and thereby locates the bolt within the circular opeing portion.

12. The method of claim 11, wherein the hub has a height which is less than the blade thickness so that tightening pressure transmitted through the nut and bolt assembly is operable to press the blade directly against a side of the shaft lower end.

13. In a stirrer system for stirring the contents in a laboratory flask, comprising, in combination: said laboratory flask having a round or spherical bottom and a reduced neck, and a stirrer shaft and a stirrer blade pivotally mounted to the shaft, the improvement comprising a nut and bolt assembly for attaching the stirrer blade to the stirrer shaft, wherein said stirrer shaft has a ring shaped lower end including a throughbore extending through the ring shaped lower end generally at a right angle to an axis of the shaft, said nut and bolt assembly being received in said throughbore.

14. In the stirrer system of claim 13, wherein the lower end of said shaft is of integral and unitary construction with the shaft.

* * * * *